United States Patent [19]

Chen et al.

[11] Patent Number: 4,537,532

[45] Date of Patent: Aug. 27, 1985

[54] COMPOSITE LOAD BEARING OUTER SKIN FOR AN ARCTIC STRUCTURE AND A METHOD FOR ERECTING SAME

[75] Inventors: Jade Chen, Humble; Jal N. Birdy; Brian J. Watt, both of Kingwood, all of Tex.

[73] Assignee: Brian Watt Associates, Inc., Houston, Tex.

[21] Appl. No.: 563,940

[22] Filed: Dec. 20, 1983

[51] Int. Cl.[3] ..... E02D 23/00; E02D 31/00; E04B 5/04

[52] U.S. Cl. ..... 405/217; 405/211; 52/600; 249/10

[58] Field of Search ..... 405/61, 195, 203–205, 405/211, 212, 216, 217; 52/333, 334, 378, 383, 598, 600; 249/4, 10, 13, 33, 36, 38, 40, 42, 117, 129, 135; 264/31, 35

[56] References Cited

U.S. PATENT DOCUMENTS

| | | | |
|---|---|---|---|
| 1,159,184 | 11/1915 | Dale | 249/33 X |
| 1,758,606 | 5/1930 | Jacobs | 405/222 |
| 1,830,397 | 11/1931 | Kleitz | 249/38 |
| 2,902,743 | 9/1959 | King | 249/10 |
| 3,348,382 | 10/1967 | Blenkarn et al. | 405/211 |
| 3,385,015 | 5/1968 | Hadley | 52/234 X |
| 4,044,522 | 8/1977 | Sturmer et al. | 52/333 X |
| 4,321,779 | 3/1982 | Kratchmer | 52/425 |
| 4,427,320 | 1/1984 | Bhula | 405/217 X |

*Primary Examiner*—Cornelius J. Husar
*Assistant Examiner*—Nancy J. Stodola
*Attorney, Agent, or Firm*—Pravel, Gambrell, Hewitt & Kimball

[57] ABSTRACT

The load bearing outer skin contains an inner assembly and an outer assembly. Both the inner and outer assemblies include a skin plate member which is stiffened by stiffeners welded to one side of the skin plate member. The stiffeners are located at spaced intervals from each other and are disposed substantially perpendicular to the skin plate member. The inner and outer assembly are placed substantially parallel to each other to form a composite structure having an internal cavity defined by the inner and outer plates. The stiffeners of the inner assembly and the outer assembly are disposed in the cavity at a spaced relation to each other and extend partly into the cavity. A cementitious material substantially fills the cavity thereby completing the load bearing outer skin structure. The stiffeners may be flat steel plates or may have the profile of structural shapes such as angles or T's among others.

11 Claims, 7 Drawing Figures

COMPOSITE LOAD BEARING OUTER SKIN FOR AN ARCTIC STRUCTURE AND A METHOD FOR ERECTING SAME

BACKGROUND OF THE INVENTION

The present invention relates to load bearing outer skins for marine structures which are suitable to support a platform for carrying out operations in arctic and sub-arctic regions. Such marine structures are particularly well suited for conducting exploration and drilling in areas such as the Alaskan Beufort Sea and serve equally well for such operations as supporting production equipment, liquefaction plants, gas compression plants, crude oil storage and offshore loading facilities in this and other such regions.

Since in most arctic and sub-arctic locations, only about two months of acceptable weather for construction per year are available, structures employing the load bearing outer skin of the present invention should ideally require a minimum amount of construction effort at the job site. Structures adapted for use in ice laden environments typically employ load bearing outer skins designed to safely resist substantial ice forces encountered when such structures are installed in an offshore location. Structures designed for offshore use in arctic environments have to withstand highly concentrated local loads from first year and multi-year ice features. Typical designs for load bearing outer skins of such structures include heavily reinforced or stiffened skin plate members for resisting local loads caused by ice formations. In the alternative, such load bearing outer skins may be formed from high strength, heavily reinforced and prestressed concrete or similar materials.

Since such offshore structures used in exploration in arctic areas must be relocated from one drilling site to another in the event a first drilling site proves unsuccessful, the overall structure needs to be light enough to be able to be floated from one location to the next with a very shallow draft.

Similarly, due to the short period available for construction in arctic or sub-arctic regions, construction techniques for building a load bearing outer skin must be simple, thereby permitting quick assembly.

DESCRIPTION OF THE PRIOR ART

In the past, load bearing outer skins for offshore arctic marine structures have been made from reinforced concrete or similar cementitious materials. A concrete load bearing outer skin required the use of costly high strength yet lightweight concrete. Furthermore, in order to achieve sufficient rigidity to resist point loads from adjacent ice formations, the concrete had to be highly reinforced and prestressed to achieve the required strength. Since flexural reinforcement, such as reinforcement bars, could not be placed at the most advantageous position near the top and bottom of the concrete surfaces, such structures were inherently inefficient. Since the forms used for pouring concrete load bearing outer skins were so congested with reinforcement in order to withstand local ice loads, workmen frequently experienced difficulty in placing and adequately vibrating the concrete to remove air voids. Vibrating the concrete was necessary not only to remove air voids within the slab but to insure the concrete was sufficiently compacted around all the reinforcement bars. Furthermore, since a concrete load bearing outer skin required structurally substantial top and bottom forms in order to support the fresh concrete, workmen frequently experienced difficulties in removing the forms from the inside of the structure once the concrete had set. Finally, although ice-bond reducing coatings have been successfully applied to metallic surfaces, such coatings have yet to be successfully applied to concrete surfaces. Accordingly, concrete load bearing outer skins for offshore structures in arctic environments incorporate several drawbacks involving high weight, high cost, and difficult assembly.

Other designs for load bearing outer skins for arctic offshore structures used various types of steel construction. One design featured a load bearing outer skin comprising an assembly of thick steel skin plates welded together. The thick steel skin plates were stiffened by T-shaped structural members connected to the underside of the thick steel skin plates to transmit ice loads to the underlying structure. The T-shaped main stiffeners were generally disposed at spaced intervals parallel to each other and welded to the inside surface of those thick steel skin plates which were to contact the ice formations. The outer skin was further stiffened by a series of secondary structural stiffeners disposed at spaced intervals parallel to each other and perpendicular to the main stiffeners. The secondary stiffeners were typically welded between the main stiffeners. The main stiffeners were continuously welded to the thick steel skin plates.

These load bearing outer skins employing a stiffened steel design suffered from several drawbacks. In order to withstand local ice loads the steel plates spanning the stiffeners had to be relatively thick and heavy thereby increasing the weight of the overall structure. A considerable amount of labor was required to cut and weld the thick steel plates as well as the structural reinforcing members. Local loads applied by ice formations to the outer skin were transferred directly and virtually without dispersal to the supporting members through the main stiffeners. Accordingly, the main stiffeners had to be sufficiently rigid to resist high local loads. Accidental impact from multi-year ice features could damage or distort the outer skin plates and the underlying stiffeners.

Another design for a load bearing outer skin for an arctic offshore structure has been to use an inner and an outer thick steel skin plate joined together by a number of steel web plates continuously welded at each end to the inner and outer thick steel skin plates. In some applications cavity formed between the inner and outer thick steel skin plates was filled with concrete or some other cementitious material. The problem with this type of design for a load bearing outer skin was that the continuous welds necessary to form the structure had to be made in a confined space. Similarly, inspection and rectification of defective welds was also impeded due to the confined quarters between the inner and outer steel skin plates during fabrication.

SUMMARY OF THE INVENTION

The present invention provides an economical and lightweight load bearing outer skin for an offshore structure used in an arctic environment and a method for its erection. The load bearing outer skin of the present invention allows loads applied to a skin plate member in contact with ice formations to be spread through a concrete in-fill thereby permitting the use of lighter structural members due to the interaction between the concrete in-fill and the skin plate members and their underlying stiffeners.

The load bearing outer skin of the present invention contains an inner assembly and an outer assembly. Both the inner and outer assemblies include a skin plate member which is stiffened by stiffeners welded to one side of the skin plate member. The stiffeners are located at spaced intervals from each other and are disposed substantially perpendicular to the skin plate member. The inner and outer assembly are placed substantially parallel to each other to form a composite structure having an internal cavity defined by the inner and outer plates. The stiffeners of the inner assembly and the outer assembly are disposed in the cavity at a spaced relation to each other and extend partly into the cavity. A cementitious material substantially fills the cavity thereby completing the load bearing outer skin structure. The stiffeners may be flat steel plates or may have the profile of structural shapes such as angles or T's among others.

The load bearing outer skin of the present invention allows horizontal shearing stress between the skin plates and the in fill cementitious material to be transferred by a bond between the two or through the weld between the skin plate member and the stiffeners followed by usage of the bond between the stiffeners and the infill cementitious material.

DESCRIPTION OF THE PREFERRED EMBODIMENT

Figure 1:
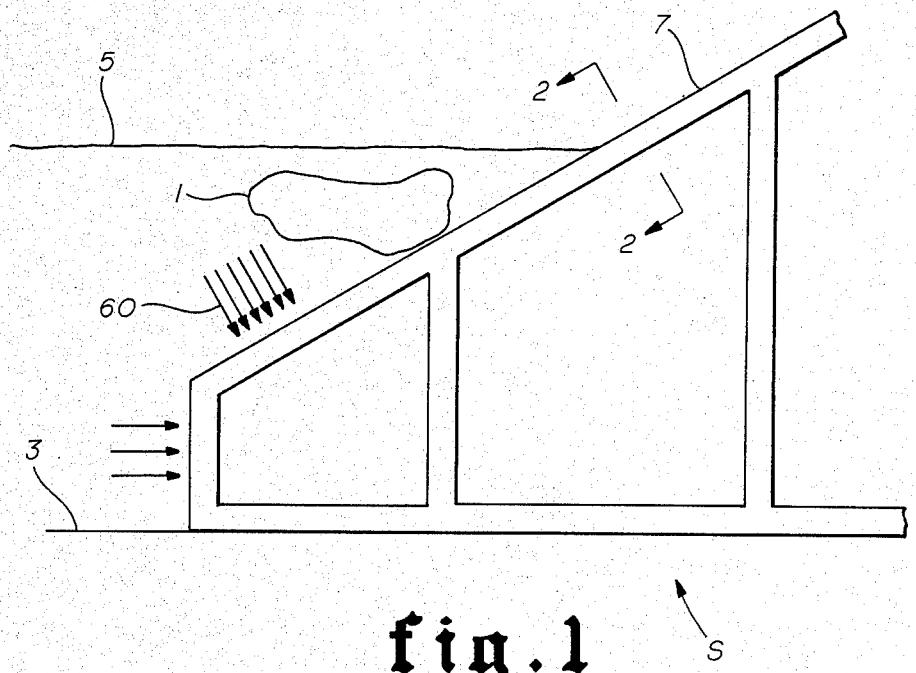
FIG. 1 is a part sectional elevation of a supporting structure located in an offshore arctic environment for supporting the load bearing outer skin of the present invention.

A marine structure containing the load bearing outer skin of the present invention is shown in FIG. 1. The structure S is typically designed for installation in arctic and sub-arctic waters upon which ice features 1 may be formed. The entire structure S may be constructed in a less hostile environment, towed to location under its own buoyancy, and installed on location by sea water ballasting. The structure S is held in place on the sea bottom 3 by its own weight plus the weight of any ballast added to the structure (not shown). The structure S extends above the water line 5 and supports the load bearing outer skin 7 of the present invention. The structure S employing load bearing outer skin 7 is suitable for supporting a stable platform from which a variety of offshore operations may be performed. These operations include, but are not limited to, exploration drilling, production drilling, hydrocarbon production, gas compression, water flood operations, enhanced hydrocarbon recovery, gas liquifaction, mineral ore extraction and processing, coal handling, storage of materials and equipment, offshore loading of tankers and other vessels, and offshore housing of personnel.

Figure 3:
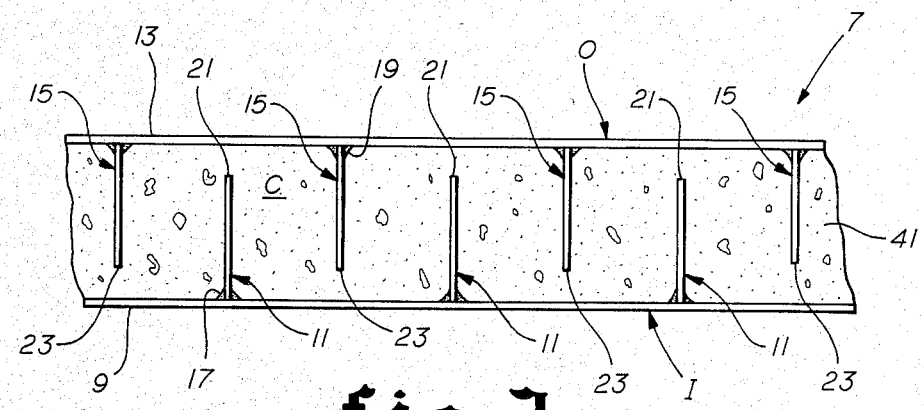
FIG. 3 is a section of the load bearing outer skin taken along lines 3—3 of FIG. 2.

Referring to FIG. 3, the load bearing outer skin 7 is composed of an inner assembly I and an outer assembly O. The inner assembly I contains a skin plate member 9 which is made of steel or another suitable high strength material compatible with the marine environment. A series of stiffeners 11 are continuously welded to skin plate member 9 and disposed in a plane perpendicular to skin plate member 9. In the preferred embodiment, stiffeners 11 are disposed parallel to each other at spaced equal intervals however, unequal intervals may be used without departing from the spirit of the invention.

The outer assembly O comprises of skin plate member 13 which is of similar construction as skin plate member 9. Skin plate member 13 is stiffened via stiffeners 15 which are disposed in a plane perpendicular to skin plate member 13. Stiffeners 15 are disposed at spaced intervals parallel to each other although a spacing employing unequal intervals is within the scope of the invention.

To form the load bearing outer skin 7 of the present invention, inner assembly I and outer assembly O are aligned substantially parallel to each other thereby forming a cavity C therebetween. As seen in FIG. 3, stiffeners 11 and stiffeners 15 extend partly into cavity C. In the preferred embodiment, stiffeners 11 extend into cavity C without reaching skin plate member 13. Similarly stiffeners 15 span a significant portion of cavity C without coming in contact with skin plate members 9. The length of stiffeners 11 and 15 is a design element determined by the requirements of each application. Accordingly, stiffeners 11 and 15 may extend less than halfway across cavity C or substantially across the entire cavity C as shown in FIG. 3.

Figure 2:
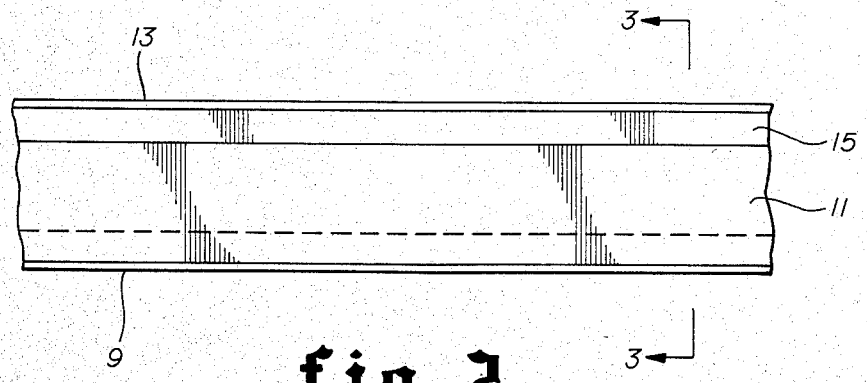
FIG. 2 is a section taken along lines 2—2 of FIG. 1.

As seen in FIG. 3, inner assembly I is juxtaposed next to outer assembly O so that stiffeners 11 straddle stiffeners 15. Although FIG. 3 displays a pattern of one stiffener 15 disposed between two stiffeners 11 and vice versa, some alternate staggering pattern between stiffeners 11 and stiffeners 15 can be employed without departing from the spirit of the invention. As shown in FIGS. 2 and 3, stiffeners 11 and 15 are elongated flat plates. Stiffeners 11 have an elongated longitudinal edge 17 which is continuously welded to skin plate members 9. Similarly, stiffeners 15 have an elongated longitudinal edge 19 continuously welded to skin plate members 13. Stiffeners 11 have a longitudinal free end 21 and stiffeners 15 have a longitudinal free end 23.

Figure 4:
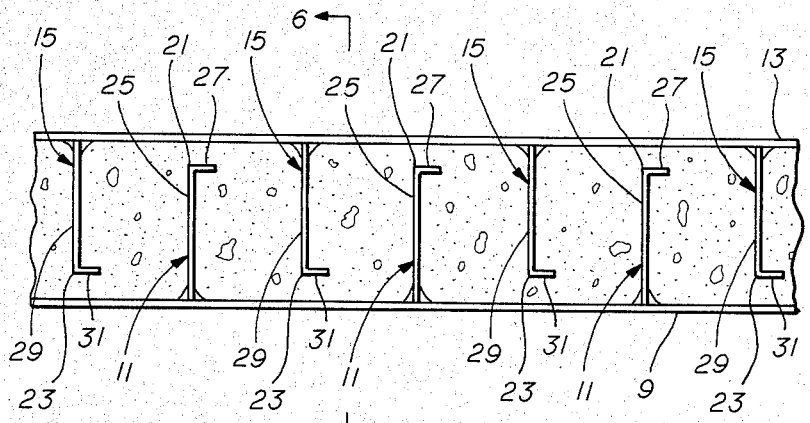
FIG. 4 shows an alternate embodiment of the load bearing outer skin employing L-shaped stiffeners.
Figure 5:
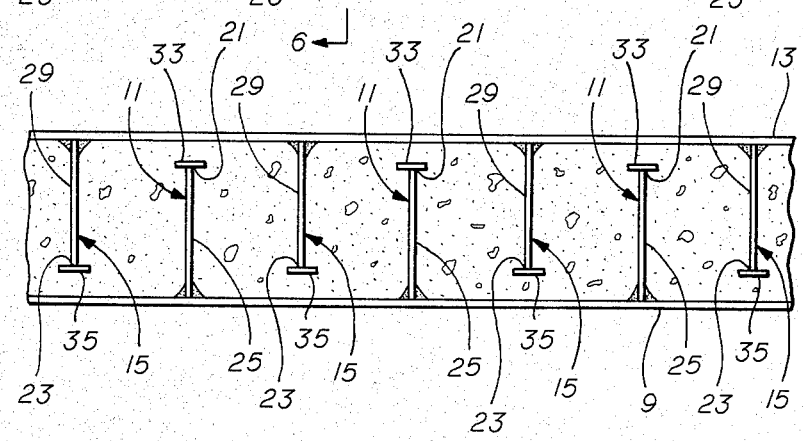
FIG. 5 is an alternate embodiment of the load bearing outer skin shown in FIG. 3 using T-shaped stiffeners.

As best seen in FIGS. 4 and 5, stiffeners 11 and 15 rather than being simply elongated flat plates may have an L or a T-shape. As seen in FIG. 4 stiffeners 11, attached to skin plate member 9, have an elongated flat plate section 25 and a flat anchor segment 27 perpendicular to elongated flat plate section 25 and attached at free end 21. Similarly, stiffeners 15 may have an elongated flat plate section 29 and a flat anchor segment 31 disposed perpendicularly to elongated flat plate section 29 and connected to free end 23 of elongated flat plate section 29. It should be noted that flat anchor segments 27 or 31 may be separate pieces connected to elongated flat plate sections 25 and 29 respectively, or stiffeners 11 and 15 may have the L-shape displayed in FIG. 4 by bending such stiffeners adjacent their free ends 21 or 23.

Stiffeners 11 and 15 may also have a T-shape (FIG. 5) by attaching flat segments 33 and 35 to free ends 21 and 23 of stiffeners 11 and 15, respectively. Flat segments 33 and 35 are disposed in cavity C substantially parallel to each other and substantially perpendicular to both elongated flat plate sections 25 and 29 of stiffeners 11 and 15, respectively. Although flat, L-shaped, and T-shaped configurations for stiffeners 11 and 15 have been described, elongated stiffeners having a different cross-section are within the purview of the present invention.

Figure 6:
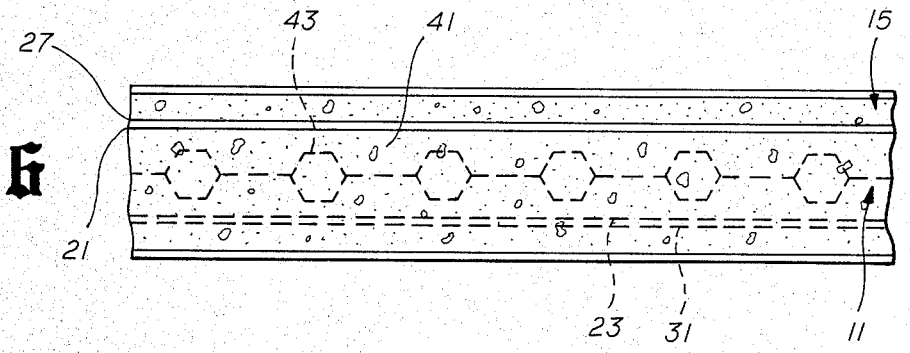
FIG. 6 is a section through the load bearing outer skin taken along lines 6—6 of FIG. 4 show in openings in the stiffeners.

Having placed the outer assembly O substantially parallel to the inner assembly I as described hereinabove, a cementitious material 41 can be poured between skin plate members 9 and skin plate members 13 thereby completing the load bearing outer skin 7 of the present invention. In order to facilitate the distribution of the cementitious material 41, to cut down on the overall weight of the load bearing outer skin 7 of the present invention, and to improve bonding, stiffeners 11 and/or 15 may contain a plurality of openings 43 as shown in FIG. 6. It is understood that although FIG. 6 represents openings 43 shown in an L-shaped stiffener 11 of FIG. 4, such openings may be used in flat plate stiffeners 11 and 15 shown in FIG. 1 as well as alternative embodiments (such as FIGS. 4 and 5) employing L-shaped or T-shaped stiffeners. In forming openings 43, elongated flat plate section 29 may be constructed in one piece with openings 43 cut out from it or, as shown in FIG. 6 elongated flat plate section 29 may be formed from two pieces each of which having had material removed from its edge.

Figure 7:
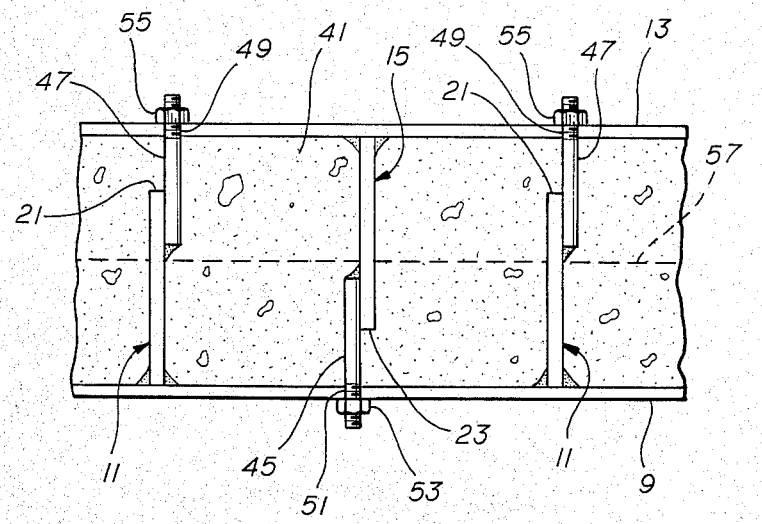
FIG. 7 is a sectional view of the load bearing outer skin showing the usage of connecting members.

Referring to FIG. 7, inner assembly I and outer assembly O can be held in place during the time when a cementitious material 41 is poured therebetween via a plurality of connecting members 45 and 47. A plurality of holes 49 are cut in skin plate member 9. Similarly, a plurality of holes 51 are cut in skin plate member 13. Connecting members 45 which can be threaded rods, or long bolts or another suitable fastening device are welded to stiffeners 15 adjacent their free end 23. Similarly, as an alternative to connecting members 45 or in addition thereto, connecting members 47 are welded to stiffeners 11 adjacent their free ends 21. Connecting members 45 extend beyond free end 23 through holes 51 in skin plate members 13. Similarly, connecting members 47 extend beyond the free ends 21 of stiffeners 11 and through holes 49 of skin plate members 9. Nuts 53 and 55 are threaded onto connecting members 45 and 47, respectively. Accordingly, nuts 53 and 55 when placed on connecting members 45 and 47 resist the tendency of inner assembly I and outer assembly O to separate when cementitious material 41 is poured therebetween. After the cementitious material 41 has been poured between inner assembly I and outer assembly O and has further had a chance to set up, nuts 53 and 55 as well as that portion of connecting members 45 and 47 protruding through the skin plates 13 and 9, respectively, may be cut off. After the cutting off operation is completed, holes 49 and 51 can be patched thereby insuring that skin plate members 13 form a continuous surface for application of any coatings, as desired. It is understood that the details of each application determine the quantity and location of connecting members 45 and 47. Similarly, only connecting members 45 or alternatively only connecting members 47 or both may be used to retain the relative positions of inner assembly I and outer assembly O during the pouring of the cementitious material 41.

Once the cementitious material 41 has hardened the load bearing outer skin 7 will function as an efficient structural system. The horizontal shearing stress distribution between skin plate member 9 and skin plate member 13 and the cementitious material 41 therebetween can be transferred in one of two ways. The shearing stress may be transferred by the bond between the cementitious material 41 and the skin plate members 9 and 13 though the bond between the two or through the welds between the skin plate members 9 and 13 to stiffeners 11 and 15, respectively, thereby relying on the bond between stiffeners 11 and 15 and the cementitious material. A similar system of horizontal shear stress transfer exists in the orthogonal direction also enabling the assembly to function as a two-way system.

Due to this interaction between the cementitious material and the inner assembly I and outer assembly O, the load bearing outer skin 7 can provide adequate strength while using concrete of a lower strength than that required in conventional prestressed concrete construction. Furthermore, placing of the cementitious material is much simpler due to the absence of complex reinforcing arrangements required in traditional prestressed concrete construction for load bearing outer skins of arctic offshore structures.

Due to the support provided by the cementitious material 41 to the skin plate member 13 coming in contact with the ice features 1, thinner steel or other equivalent high strength material can be used. Similarly, stiffeners 11 and 15 may also be thinner than conventional steel construction due to the restraint against buckling provided by the cementitious material 41 which completely surrounds stiffeners 11 and 15. Importantly, local loads applied to the outer surface of skin plate member 13 by ice features 1 (which are typically in a normal direction as shown by arrows 60 in FIG. 1) are spread through the cementitious material 41 within cavity C thereby reducing loads on support members of structure S thereby reducing overall costs. Furthermore, since skin plate members 9 and 13 are placed at the furthest possible distance from the neutral axis 57 (see FIG. 7), thinner plates than in conventional steel construction may be used.

From a construction standpoint, the load bearing outer skin 7 of the present invention provides many construction economies. Skin plate members 9 and 13 act as a formwork for the cementitious material 41 thereby eliminating a substantial cost item as compared to using a concrete load bearing outer skin. Inner assembly I and outer assembly O may be easily constructed in a fabrication shop in a relatively open environment as opposed to load bearing outer skins employing steel construction wherein stiffeners must be continuously welded to an inner and an outer steel plate in a confined space. For the same reasons, inspection and rectification of faulty welds is considerably simpler.

The composite structure of the load bearing outer skin 7 of the present invention further enables the structure S to absorb accidental impact from multi-year ice features 1 without distorting skin plate member 13 or stiffeners 15 attached thereto. Finally, ice bond reducing coatings, may be confidently applied to the steel skin plate member 13 since such coatings have a known efficacy when applied to steel surfaces. The efficacy of such coatings on concrete surfaces is yet unproven.

The foregoing disclosure and description of the invention are illustrative and explanatory thereof, and various changes in the size, shape and materials, as well as in the details of the illustrated construction may be made without departing from the spirit of the invention.

We claim:

1. A load bearing outer skin for an arctic offshore structure comprising:

an inner assembly;

an outer assembly aligned substantially parallel to said inner assembly and defining an internal cavity therebetween;

said inner and outer assemblies each comprising:

a skin plate member;

a plurality of stiffeners attached at spaced intervals to said skin plate member and mounted substantially perpendicular to said skin plate member so as to extend partially into the internal cavity;

whereupon said stiffeners of said inner assembly are out of contact with said skin plate member of said outer assembly and said stiffeners of said outer assembly are out of contact with said skin plate member of said inner assembly; and a cementitious material substantially filling the internal cavity;

whereupon shear forces exerted on said skin plate member of said outer assembly are transferred to said inner skin plate member through the bond between said cementitious material and said skin plate members; and also via said stiffeners connected to said outer skin plate member whereupon said shear forces are then transmitted to said stiffeners on said inner skin plate member through said cementitious material and then to said inner skin plate member, thereby allowing said inner and outer assembly and said cementitious material to form a composite flexural member in resisting applied loads.

2. The load bearing outer skin of claim 1 wherein:

each of said stiffeners is an elongated flat plate having a first longitudinal edge attached to said skin plate member and a second longitudinal edge extending into said cavity.

3. The load bearing outer skin of claim 2 wherein:

said stiffeners are formed having a plurality of openings formed therein to facilitate the flow of said cementitious material therethrough, and increase the bond strength between said cementitious material and said stiffeners.

4. The load bearing outer skin of claim 2 wherein each of said stiffeners further contains:

a flat anchor segment, said flat anchor segment connected to said second longitudinal edge of said stiffener and disposed substantially perpendicular to said elongated flat plate and substantially parallel to said skin plate member thereby giving said stiffener an L-shape when viewed along its longitudinal axis.

5. The load bearing outer skin of claim 2 wherein:

each of said stiffeners has a flat anchor segment adjacent its second longitudinal edge, said flat anchor segment being integral with said stiffener and disposed in a plane parallel to said skin plate member thereby giving said stiffener an L-shape when viewed along its longitudinal axis.

6. The load bearing outer skin of claim 4 wherein:

said stiffeners are formed having a plurality of openings formed therein to facilitate the flow of a cementitious material through said stiffeners and increase the bond strength between said cementitious material and said stiffeners.

7. The load bearing outer skin of claim 2 wherein each of said stiffeners further includes:

a flat segment, said flat segment connected to said second longitudinal end of said stiffener and disposed substantially perpendicular to said elongated flat plate and substantially parallel to said skin plate member thereby giving said stiffener a T-shape when viewed along its longitudinal axis.

8. The load bearing outer skin of claim 7 wherein:

each of said stiffeners are formed having a plurality of openings formed therein to facilitate the flow of a cementitious material therethrough and increase the bond strength between said cementitious material and said stiffeners.

9. The load bearing outer skin of claim 1 wherein:

said skin plate member is formed having a plurality of openings;

a plurality of elongate connecting members, each having a cross-section conforming to the shape of one of said openings, and connected to said stiffeners and spanning said cavity and extending through one of said openings in an opposing skin plate member; and securing means attached to the end of said elongate connecting members extending through said openings for retaining said skin plate members to each other until said cementitious material has been poured and set up in said cavity whereupon said securing means may be removed.

10. A method of assembly of a load bearing outer skin for an arctic offshore structure comprising the steps of:

fabricating an inner assembly;

fabricating an outer assembly;

said inner and outer assemblies each comprising:

a skin plate member; and a plurality of stiffeners attached at spaced intervals to said skin plate member and mounted substantially perpendicular to said skin plate member;

aligning said outer assembly substantially parallel to said inner assembly thereby forming a cavity, said stiffeners being disposed in said cavity at spaced intervals from each other and extending partially into said cavity, whereupon said stiffeners of said inner assembly are out of contact with said skin plate member of said outer assembly and said stiffeners of said outer assembly are out of contact with said skin plate member of said inner assembly;

cutting holes into at least one of said skin plate members;

fastening connecting members adjacent a free longitudinal end of at least one of said stiffeners, each of said connecting members spanning said cavity and extending through one of said holes in an opposing skin plate member;

securing the connecting member to an opposing skin plate member outside said cavity;

substantially filling said cavity with a cementitious material, whereupon shear forces exerted on said skin plate member of said outer assembly are transferred to said inner skin plate member through the bond between said cementitious material and said skin plate members; and also via said stiffeners connected to said outer skin plate member whereupon said shear forces are then transmitted to said stiffeners on said inner skin plate member through said cementitious material and then to said inner skin plate member, thereby allowing said inner and outer assembly and said cementitious material to form a composite flexural member in resisting applied loads; and cutting off said portions of said connecting members which extend through said holes in said skin plate member.

11. The method of claim 10 further including the step of:

erecting said inner and outer assemblies on an offshore support structure before pouring the cementitious material.

* * * * *

UNITED STATES PATENT AND TRADEMARK OFFICE

CERTIFICATE OF CORRECTION

PATENT NO. : 4,537,532

DATED : August 27, 1985

INVENTOR(S) : JADE CHEN, JAL N. BIRDY, BRIAN J. WATT

It is certified that error appears in the above-identified patent and that said Letters Patent is hereby corrected as shown below:

In the drawings, sheet 1, Fig. 2, remove the section line 3-3 which passes through the figure on the righthand side.

In the drawings, sheet 1, Fig. 3, insert a section line 3-3 so as to pass through skin plate members 9 and 13 in the same manner as said section line 3-3 was shown in Fig. 2.

In column 3, line 33, remove "2-2 of Fig. 1" and insert --3-3 of Fig. 3-- therefor.

In column 3, line 35, remove "3-3 of Fig. 2" and insert --2-2 of Fig. 1-- therefor.

In column 3, line 42, remove "show in" and insert --showing-- therefor.

Signed and Sealed this

*Fourth* Day of *March 1986*

[SEAL]

*Attest:*

DONALD J. QUIGG

*Attesting Officer*

*Commissioner of Patents and Trademarks*